XR 4,072,933

X 340-592

United State

Pun 4,072,933

Feb. 7, 1978

X 340-566

[54] FIRE HEAT DETECTOR AND/OR BURGLAR ALARM

[75] Inventor: Kwok-Wah Pun, Kowloon, Hong Kong

[73] Assignee: Cheung King Fung, Kowloon, Hong Kong

[21] Appl. No.: 645,439

[22] Filed: Dec. 30, 1975

[30] Foreign Application Priority Data

Jan. 6, 1975 United Kingdom ..... 369/75

[51] Int. Cl.² ..... G08B 17/04

[52] U.S. Cl. ..... 340/229; 337/320; 337/323; 337/328; 337/332; 340/227.1

[58] Field of Search ..... 340/227 R, 227 D, 227.1, 340/240, 229; 337/306, 314, 320, 323, 327, 328, 332; 200/83 R, 83 A, 83 N, 83 W

[56] References Cited

U.S. PATENT DOCUMENTS 1,199,050 9/1916 Cid ..... 340/227 R 2,735,913 2/1956 Bland et al. ..... 340/229 X 3,822,371 7/1974 Welsh ..... 337/320 X

*Primary Examiner*—Glen R. Swann, III

[57] ABSTRACT

A detecting device for detecting heat due to the presence of fire for example. The detecting device includes an open-ended chamber closed by a resilient diaphragm. The diaphragm engages the open end to permit respectively the passage of air via an annular passageway formed between an outer peripheral portion of the diaphragm and a circumferential rim of the open end which it engages for closing the chamber, upon pressure build-up in the chamber due to the external temperature variation. This pressure build-up causes corresponding expansion of the diaphragm to thereby actuate an electrical circuit provided with means for emitting an audible sound. Means are also provided in the detector to make it operative in response to the presence of moving objects.

15 Claims, 7 Drawing Figures

FIRE HEAT DETECTOR AND/OR BURGLAR ALARM

The present invention relates to a detecting device and to a detecting device for detecting heat due to the presence of fire.

Fire detecting devices presently available are mainly the so-called metal expansion type which do not respond to temperature variation until the ambient temperature has reached a range of 120°–140° F. It is apparent that detection will be made too late to take the best and most efficient action for preventing a fire disaster or decreasing the extent of damage.

Recently, the gas expansion type fire detector has been introduced and employed which utilizes pressure changes produced in an enclosed air chamber due to external temperature rise, the air chamber being provided with a small hole or vent for releasing the slight elevated pressure to the outside atmosphere. But since the air always contains a lot of moisture, dust, hair, smog, chemical vapour and small insects which readily plug the small hole or vent and result in reduced precision of the device, or even cause it to be ineffective.

The primary object of the present invention is to provide a high sensitive device for detecting heat which will immediately respond when the ambient temperature has accidentally increased over 2° F per minute.

According to the present invention there is provided a detecting device comprising a thermally conductive container having an open end, a resilient diaphragm mounted across the open end to close the container and for expansion in response to pressure changes in the container corresponding to variation of temperature externally of the container, said diaphragm having an outer peripheral portion in close-fit non-hermetic sealing engagement with the peripheral surface of the container at its open end to form an annular venting passageway between said surface and the peripheral portion of the diaphragm, and indicating means responsive to expanding movements of said diaphragm for translating the movements into audible sound.

The device may be provided with means for detecting the presence of moving bodies and thus act as a detecting device for detecting the presence of burglars.

The present invention will now be described by way of example with reference to and as illustrated in the accompanying drawings, in which.

Figure 6:
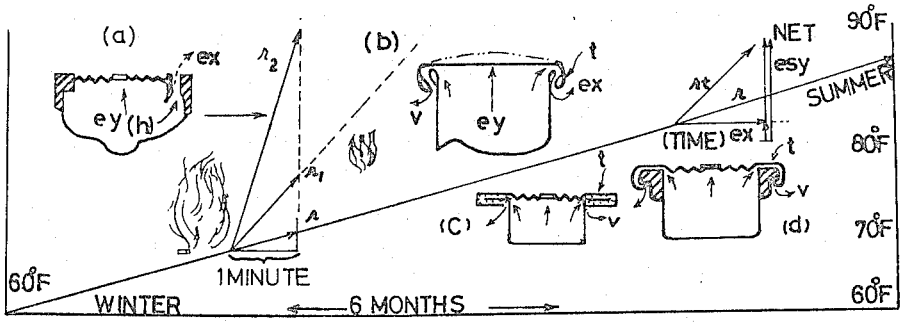
Figure 7:
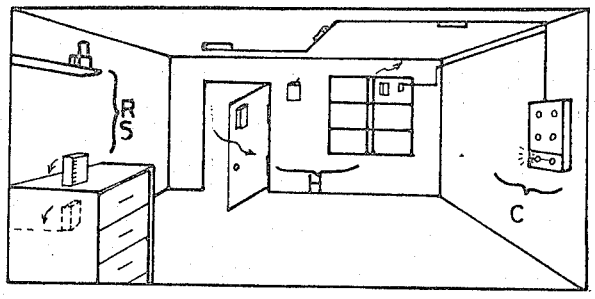

FIGS. 6, 6(*a*), 6(*b*(, 6(*c*), 6(*d*) are diagrammatic layouts illustrating the advantages of the present invention; and FIG. 7 illustrates the positions at which the present device may be mounted in a room.

Figure 1:
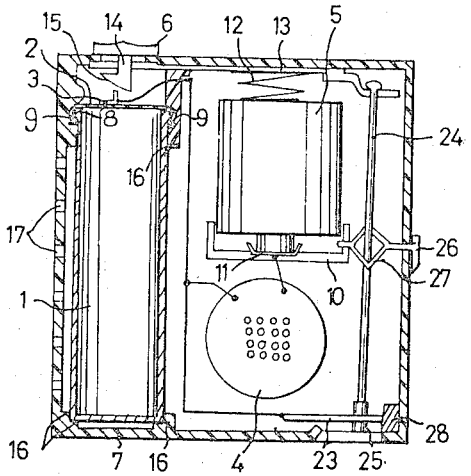
FIG. 1 is a partial sectional view of a device for heat detection according to the present invention.

With reference to FIG. 1 the detector shown comprises a container 1, a resilient actuated diaphragm 2, a conductive plate 3, a buzzer 4, an electrical power supply 5, a switch 6 and a case 7.

The container 1 has an open end and is made of a thermally conducting metal, in which titanium, aluminium and copper is preferred. Since the heat transfer coefficient is adversely proportional to the thickness of the conductive wall, the container 1 has a thin wall advantageous for temperature sensitivity. The rim of the open end is provided with an outwardly peripheral protrusion 8.

The resilient actuated diaphragm 2 either made of heat resilient rubber or metal sheet is mounted to the open end of the container 1 and an outer edge thereof is folded downwardly and inwardly around the circumference of the end of container 1 and under the protrusion 8 to form a circular vent 9 for restricting the passage of air.

The conductive plate 3 is made of an electrically conductive material, and copper is preferred. As illustrated in FIFG. 1, an L-shaped cross-section of the plate 3 is shown, but the configuration of the plate 3 is not limited to such a shape. The conductive plate 3 is electrically connected to the buzzer 4, then series connected to an electrical power supply 5. The power supply 5 is preferably a direct correct supply.

A dry cell holder 10 for supporting the cell 5 is formed on an inner side of a casing 7 housing the container 1, buzzer 4 and dry cell 5. The holder 10 is provided with a contacting plate 11 for electrical connection to the buzzer 4. Another end of the dry cell 5 is connected to the contacting plate through a spring coil 12 for maintaining good electrical contact. The contacting plate 13 may be replaced by wire as well known.

A push type switch 6 is mounted in the casing 7 and provided with a regulating means 14 having a contacting member with an inclined lower surface 15 at its lower end. With displacement of the switch 6, the distance to be moved for contact between the regulating means 14 and the conductive plate 3 is varied. The displacement can be stepwise as required. For instance, when the switch 6 is pushed leftwards in the drawing, the circuit as shown will be energized due to the fact that the inclined contacting surface 15 comes in contact with the conductive plate 3 to cause actuation of the buzzer 4. This is a test procedure regardless of the thermal expansion of the air contained within the container 1 to effect movement of the reslient actuated diaphragm 2. When the switch 6 is pushed rightward in the drawing to the position as shown in FIG. 1, the inclined contacting surface 15 is moved away from the conductive plate 3 a certain distance, and the circuit will only be energized after the diaphragm 2 is moved by expanding air within the container 1 outwardly to an extent that the conductive plate 3 makes contact with the inclined contacting surface 15. Suppose the switch 6 is pushed further towards the right-hand side, the distance between the contacting surface 15 and conductive plate 3 is greater and the sensitivity of the present device is less. Hence, at stable room temperature, such as in a bed room, office or warehouse, the present device is preferably preset at a relatively higher sensitive in order that detection is effected earlier. On the contrary, in an area of fluctuating temperature, such as in a kitchen, bath room, or workshop, it is recommended to preset at a relatively lower sensitive to avoid unnecessary alarm owing simply to temperature fluctuation at normal condition. When the switch 6 is pushed to the extreme right-hand side, the inclined surface 15 is furthest already away from the conducting plate 3. In these circumstances, there is no way that the conductive plate 3 may contact the switch 6, i.e. the device is switched off.

The casing 7 which encloses and protects all parts except the switch 6 is unitary moulded of plastics. Inside of the casing 7 a plurality of supports 16 are disposed at suitable positions to support the container 1 and diaphragm 2. The casing 7 is provided with a plurality of openings or slots 17 so that the container 1 is in direct contact with atmosphere and thus immediately responds to the variation of ambient temperature.

Figure 2:
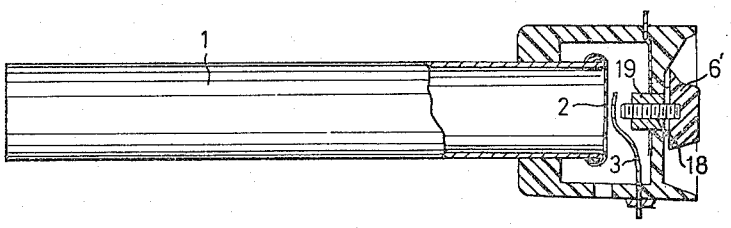
FIG. 2 is a partial sectional view showing another embodiment of a temperature sensitive means.

With reference to FIG. 2 the regulating means 14 of FIG. 1 may be replaced by a regulating screw 18, instead of a contacting member 15. When the switch 6' is turned clockwise, the screw 18 moves downwards i.e., leftwards in FIG. 2 and with the smaller distance to the conducting plate 3, the higher the sensitivity of detection, until the lowest position in contact with the conductive plate 3 under normal conditions initiates the testing procedure. On the contrary, when the switch 6' is turned counterclockwise, the screw 18 moves upwards, i.e. rightwards in FIG. 2 with decreasing sensitivity until the whole screw 18 is retained within the bush 19 and the device is switched-off.

Figure 3:
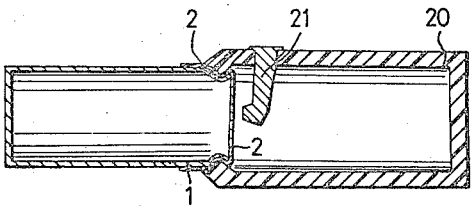
FIG. 3 is a cross-sectional view of a combined temperature sensitive means and temperature insensitive means.

With reference to FIG. 3 a temperature insensitive container means 20 made of a material having a thermal conductivity far less than that of the container 1, such as plastics is combined with the container 1 with the resilient actuated diaphragm 2 as an interface. In this embodiment, the diaphragm is preferably metal sheet which extends to outside of the container 1 to serve as a negative electrode while a metal rod 21 is inserted into the temperature insenitive means 20 to act as a positive electrode. As the ambient temperature varies, heat transfer through the container 1 is faster so that thermal expansion of the air within the container 1 will build-up much faster than that in the container means 20. This causes the diaphragm 2 to bend toward the side of the temperature insensitive container means 20. When the diaphragm 2 makes contact with the metal rod 21, the electrical circuit of the device will be energized.

Figure 4:
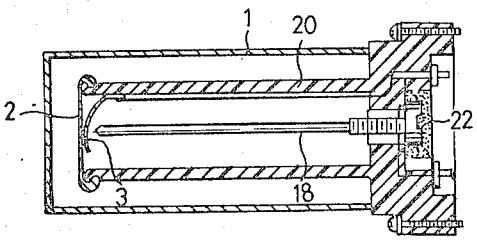
FIG. 4 is a cross-sectional view showing another embodiment of the combination of FIG. 3.

A further alternative embodiment is shown in FIG. 4. In this case, the temperature insensitive container means 20 is contained inside the container 1 which is temperature sensitive, while the resilient actuated diaphragm 2 is mounted on the mouth of the container means 20 and the conductive plate 3 is mounted in spaced relation on the inner side of the diaphragm 2 and interiorily of container means 20. The screw regulating means 18 (which replace regulating means 14 of FIG. 1) terminates at a suitable distance from the plate 3. As the ambient temperature is varied, the build-up of gas pressure inside the container means 20 is slower than that enclosed within the circular space between the container means 20 and the container 1, so that the diaphragm will bend inwards to force the conductive plate 3 to make contact with the screw regulating means 18 and energize the circuit.

A sealing material 22 is introduced around the exterior screw head of the regulating means 18 as soon as the desirable sensitivity of the detector is achieved to fix its sensitivity corresponding to the rate of temperature rise required for the detector to operate.

Figure 5:
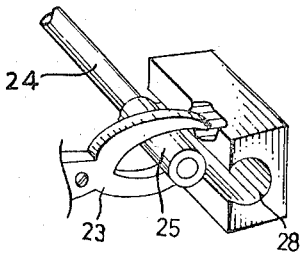
FIG. 5 is a perspective view showing the relationship between a vibrating rod member and a conductive member for burglar alarm use incorporating in the detecting device for detecting heat.

The detecting device according to the present invention can be modified to serve as a burglar alarm simultaneously as a fire detector. In this case, as best shown in FIGS. 1 and 5, an additional ring-shaped conductive member 23 is provided, and electrically connected to the buzzer 4. A vibrating rod 24 is connected at one end to the electrical power supply 5 via a contacting plate and extends at its free end to reach and pass through the ring shaped conductive member 23. When an accidental vibration is produced in the area of the device the free end of the vibrating rod 24 will contact any point of the ring shaped conductive member 23 in response to the vibration to cause the circuit to be energized, and an alarm is thus provided. The free end can be advantageously provided with a magnet 25, for permitting the vibrating rod 24 magnetically affixed on the conductive member 23 upon vibration to have the buzzer 4 ring continuously, until released manually. A burglar alarm releasing means comprises an insulated handle 26 and an actuating member 27 which is formed, for example, around the vibrating rod 24 and rotatably secured on the dry cell holder 10. The actuating member 27 will act on the rod 24 by means of operating the handle 26 to release the free end 25 of the rod 24 from magnetically contacting with the conductive member 23 to de-energise the electrical circuit.

The burglar alarm modification is very sensitive. When it is attached on, for example, doors, windows, and valuable goods, such as a television set, an alarm signal will be instantly produced as soon as the door or window is opened or as the television set is removed.

A stop means 28 in the shape of a notched recess is also provided. The rod 24 is held by the stop means 28 when inserted therein and the rod 24 is then not able to make contact with the conductive member 23 no matter how vigorous the vibration of the rod 24.

With reference to FIG. 6 the advantages of the present invention over prior known devices is demonstrated in relation to a graph of temperature versus time. The known heat detector FIG. 6*a* gives up its excess pressure *ex* through a vent hole *h* rather quickly and thus it can only detect a high rate of heat increase (say 70° F per minute) of $r_2$ (see graph). The present device shown part schematically in FIG. 6*b* however is more sensitive and in which the escaping air depends on the tightness fit of the diaphragm 2 at point *t* on the container 1. FIGS. 6*c* and 6*d* show how a thin metal diaphragm 2 can be clipped at the open end of chamber 1 to form an annular vent at *t* for slower escaping air *v*. This results in reliable heat sensing of about 2°–3° F per minute $r_1$ (see graph) which depends on the rate of expansion *ly* and rate of air escape *ex*. Therefore a small fire can be detected by the device of the invention.

FIG. 7 shows three methods of mounting the detecting device in a room. It may be positioned at point R for sensing rising heat, at point S for sensing vibrations of a table. It may also be mounted vicinal a door or window at point H or in a centralised position at point C the point C being connected to a main alarm in a central watching area provided with visual display warning panel.

I claim:

1. A detecting device comprising a thermally conductive container having an open end, a resilient diaphragm mounted across the open end to close the container and for expansion in response to pressure changes in the container corresponding to variation of temperature externally of the container, said diaphragm having an outer peripheral portion in close-fit non-hermetic sealing engagement with the peripheral surface of the container at its open end to form an annular venting passageway between said surface and the peripheral portion of the diaphragm, the open end of the container terminating in a circumferential rim which is provided with an annular protruding lip for engagement with said outer peripheral portion of the diaphragm, and indicating means responsive to expanding movements of said diaphragm for translating the movements into audible sound, said indicating means comprising a conductive plate member mounted for actuation by expanding movements of said diaphragm, a buzzer connected at one end to said conductive plate and at another end to an electrical power supply mounted vicinal to said container and said buzzer, and a switch for connecting said conductive plate to the electrical power supply to actuate the buzzer.

2. A device as claimed in claim 1, wherein said container is made of a metal having a light thermal conductivity.

3. A device as claimed in claim 2, wherein said metal is selected from a group consisting of titanium, aluminium and copper.

4. A device as claimed in claim 1, wherein regulating means coupled to the switch is provided for adjusting the distance of contact between said switch and said conductive plate.

5. A device as claimed in claim 4, wherein said regulating means is a contacting member having an inclined contacting surface whereby the distance to said conductive plate may be adjusted by displacing said switch.

6. A device as claimed in claim 4, wherein said regulating means is a screw operated member whereby the distance to said conductive plate may be adjusted by rotating said switch.

7. A device as claimed in claim 2 further comprising a temperature insensitive container means coupled to said container with said diaphragm forming an interface therebetween, said temperature insensitive container means having a thermal conductivity less than that of said container.

8. A device as claimed in claim 1 wherein said container has a low thermal conductivity and is enclosed within another container having a high thermal conductivity.

9. A device as claimed in claim 8 wherein said plate member is mounted interiorily of said container of low thermal conductivity, and regulating means is provided coupled to said switch for adjusting the distance of contact between said switch and said conductive plate.

10. A device as claimed in claim 8 wherein said regulating means is a screw operated member whereby the distance between said switch and the conductive plate may be adjusted by rotating sid switch.

11. A device as claimed in claim 1, further comprising a conductive member electrically connected to said buzzer, and a vibrating rod responsive to external movement and connected at one end to the electrical power supply and extending via another end to said conductive member for contact therewith upon vibration thereof.

12. A device as claimed in claim 11, wherein said vibrating rod at a portion corresponding to the position of said conductive member is magnetic.

13. A device as claimed in claim 11, wherein said conductive member is a ring, the free end of said vibrating rod extending through said ring.

14. A device as claimed in claim 11, further comprising stop means for arresting vibrations of said vibrating rod.

15. A device as claimed in claim 11, further comprising an alarm releasing means for preventing vibrations of said rod and consists of an acting member for acting on said vibrating rod said acting member being connected to an operating handle for actuation thereby.

* * * * *